US011661779B2

(12) United States Patent
Brannstrom

(10) Patent No.: US 11,661,779 B2
(45) Date of Patent: May 30, 2023

(54) FLOOR PIT COVERING SYSTEM

(71) Applicant: ASSA ABLOY ENTRANCE SYSTEMS AB, Landskrona (SE)

(72) Inventor: Mats Brannstrom, Skelleftea (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 1072 days.

(21) Appl. No.: 16/310,721

(22) PCT Filed: Jun. 26, 2017

(86) PCT No.: PCT/EP2017/065718
§ 371 (c)(1),
(2) Date: Dec. 17, 2018

(87) PCT Pub. No.: WO2018/001966
PCT Pub. Date: Jan. 4, 2018

(65) Prior Publication Data

US 2019/0194994 A1 Jun. 27, 2019

(30) Foreign Application Priority Data

Jun. 29, 2016 (SE) ..... 1630166-5

(51) Int. Cl.
*E05D 15/00* (2006.01)
*E05D 15/24* (2006.01)

(52) U.S. Cl.
CPC ..... *E05D 15/248* (2013.01); *E05D 15/24* (2013.01)

(58) Field of Classification Search
CPC ..... E05D 15/248; E05D 15/24
See application file for complete search history.

(56) References Cited

U.S. PATENT DOCUMENTS 2,264,182 A 11/1941 Miller
3,217,784 A 11/1965 Wolf et al.
3,672,098 A * 6/1972 Webb, Jr ..... E05D 15/24 49/365

(Continued)

FOREIGN PATENT DOCUMENTS

DE 202014000197 * 11/2014 ..... E06B 3/485
EP 1258586 A2 * 11/2002 ..... E05D 15/262

(Continued)

OTHER PUBLICATIONS

International Search Report and Written Opinion mailed in PCT/EP2017/065718 dated Aug. 29, 2017.

(Continued)

*Primary Examiner* — Janet M Wilkens
*Assistant Examiner* — Daniel Alvarez
(74) *Attorney, Agent, or Firm* — Wissing Miller LLP

(57) ABSTRACT

The present invention relates to a floor pit covering system comprising a cover plate (1) and a pivoting system (2). The pivoting system (2) is adapted for arranging the cover plate (1) in a first end position (P1) or in a second end position (P2) in response to an internal force (FI), or an internal force (FI) and an external force (FE), being applied onto the cover plate (1). The cover plate (1) is arranged in the first end position (P1) when force FE≤FI and in the second end position (P2) when force FE>FI. The present invention further relates to a method of operating such a system.

10 Claims, 2 Drawing Sheets

(56) References Cited

U.S. PATENT DOCUMENTS

| | | | | |
|---|---|---|---|---|
| 4,050,723 | A * | 9/1977 | Papadatos | E05C 17/446<br>292/164 |
| 6,385,916 | B1 | 5/2002 | Marko | |

FOREIGN PATENT DOCUMENTS

| | | | | |
|---|---|---|---|---|
| EP | 1275806 | A2 * | 1/2003 | E05C 17/50 |
| EP | 1405977 | | 4/2004 | |
| EP | 1536094 | | 6/2005 | |
| GB | 668560 | | 3/1952 | |

OTHER PUBLICATIONS

Swedish Search Report mailed in SE 16301765-5 dated Dec. 30, 2016.

* cited by examiner

FLOOR PIT COVERING SYSTEM

This application is a 371 of PCT/EP2017/065718 filed on Jun. 26, 2017, published on Jan. 4, 2018 under publication number WO 2018/001966, which claims priority benefits from Swedish Patent Application No. 1630166-5 filed Jun. 29, 2016, the disclosure of which is incorporated herein by reference.

FIELD OF THE INVENTION

The present invention relates to a floor pit covering system to be used primarily in relation to large vertical lifting doors, and a method of operating such a system.

BACKGROUND OF THE INVENTION

Vertical lifting doors are frequently used for extremely large door openings, such as those of aircraft hangars and shipyard halls. In certain applications, it may be advantageous to split a large opening into two or more smaller openings using a pivotable mullion system. Such a solution increases the flexibility of the door system, while also saving energy.

The lower end of a conventional mullion is provided with a pin which is to be inserted into a corresponding floor pit. In order to avoid accidents, e.g. caused by stepping into a floor pit, and to allow vehicles to pass over a floor surfaces, each floor pit is provided with a pivotable cover plate, covering the floor pit opening. These cover plates have to be opened and closed manually, which is a heavy and time consuming process. Further, opening/closing of one or more floor pits could easily be forgotten, resulting in damage to personnel, doors or vehicles.

SUMMARY OF THE INVENTION

It is an object of the present invention to mitigate the above problems, and to provide a floor pit covering system which can be constructed by standard components. According to a first aspect of the present invention, these objects are achieved by a floor pit covering system comprising a cover plate and a pivoting system, the pivoting system being adapted for arranging the cover plate in a first end position or in a second end position in response to an internal force, or an internal force and an external force, being applied onto the cover plate, the cover plate being arranged in the first end position when force FE≤FI and in the second end position when force FE>FI.

Such a solution allows the floor pit covering system to be operated automatically without personnel having to open each floor pit manually. Further, the risk of damaging the mullion, the motorized base pin, the mullion lifting cable or the floor pit covers is significantly reduced. Further, the tripping hazard is greatly reduced as well as the risk of personal injury from stepping into an opening in the floor.

In one embodiment, the pivoting system comprises an articulated joint system and at least one spring, constituting a simple and well-tried solution for transferring forces between vertical and horizontal directions.

The internal force may be generated by the spring.

The cover plate may be arranged at a first end of the articulated joint system, and the spring may be arranged at a second end of the articulated joint system, such that the length of the articulated joint system is kept to a minimum.

In one embodiment, the articulated joint system comprises a plurality of interconnected components.

In a further embodiment, the spring is compressed when the cover plate is arranged in the second end position, allowing the internal force, generated by the spring, to move and hold the cover plate in the first end position as long as no external force is generated by a mullion pin.

The first end position may be a horizontal position and the second end position may be a vertical position.

In one embodiment, the floor pit is closed when the cover plate is arranged in said first end position, and the floor pit is open when the cover plate is arranged in the second end position, restricting the floor pit to the options of either being closed or receiving a mullion pin.

According to a second aspect of the present invention, these objects are achieved by a method of operating a floor pit covering system according to the above, comprising the steps of: applying an internal force onto the cover plate such that the cover plate is held in a first end position, applying an external force onto the cover plate, moving the cover plate to a second end position when force FE>FI, holding the cover plate in the second end position as long as force FE>FI, removing the external force from the cover plate, returning the cover plate to the first end position when force FE≤FI. This method allows the floor pit covering system to be operated automatically without personnel having to open each floor pit manually. Further, the risk of damaging the mullion, the motorized base pin, the mullion lifting cable or the floor pit covers is significantly reduced. Further, the tripping hazard is greatly reduced as well as the risk of personal injury from stepping into an opening in the floor.

In one embodiment, the first end position is a horizontal position, and the second end position is a vertical position.

In a further embodiment, the floor pit is closed when the cover plate is arranged in the first end position, and the floor pit is open when the cover plate is arranged in the second end position, restricting the floor pit to the options of either being closed or receiving a mullion pit.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

This and other aspects of the present invention will now be described in more detail, with reference to the appended drawings showing a currently preferred embodiment of the invention.

DETAILED DESCRIPTION

Figure 1:
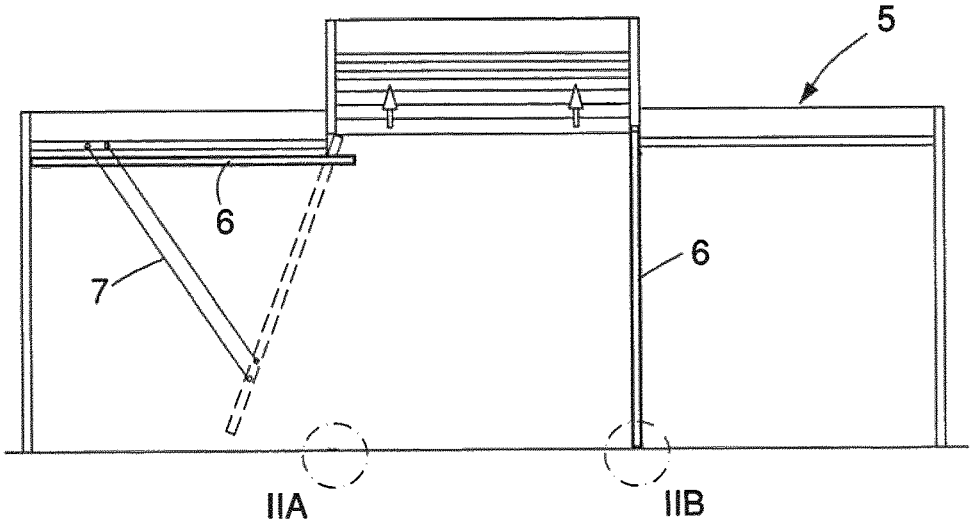
FIG. 1 shows a schematic front view of a vertical lifting door provided with pivotable mullions.

As previously mentioned, vertical lifting doors are used when covering extremely large door openings. A very large door opening may be split into several smaller door openings using smaller door sections 5 and pivotable mullions 6 arranged between each such door section, as shown in FIG. 1. FIG. 1 shows three door sections 5, arranged side by side, and one mullion 6 arranged between each adjacent pair of door sections 5.

Each mullion 6 is hinged, at its upper end, to the upper edge of the door opening. Further, each mullion 6 is connected to lifting means, such as cables 7. Consequently, the mullion 6 is upwardly foldable and of a so called "swing-up mullion" type. The opposite, lower end of the swing-up mullion 6 only rests against a floor, such as a concrete floor, when the mullion extends completely vertically, i.e. when the door opening is to be, at least partially, sealed off using the above mentioned door sections 5.

In order to fixate the mullion 6 in its vertical position, its lower end has to interconnect with the floor. Conventionally, the lower end is provided with axially movable locking means such as a pin 8. The pin 8 is operated by means of a motor, and is slid, from the interior of the mullion 6, vertically downwards such that it protrudes from the end of the mullion into a corresponding opening in the floor, a floor pit 9. Correspondingly, when the mullion 6 is to be folded upwards, the pin is moved axially back into the interior of the mullion 6.

The present invention relates to a floor pit covering system used for automatically opening and closing a floor pit in response to the presence, or absence, of a mullion. The floor pit covering system comprises a pit cover plate 1 and a pivoting system 2, as shown in FIGS. 2A, 2B, 3, and 4, one such system being arranged in each floor pit 9. Most of the floor pit 9 upper part is covered by a base plate 10 which is fixed to parts of the floor adjacent to the floor pit 9, usually by bolting. The base plate 10 is provided with an opening 11 in which the pit cover plate 1 fits. Behind the base plate with respect to the pit cover plate 1 there is a removable service plate or hatch 12 which enables easy access to the pivoting system 2.

Figure 2A:
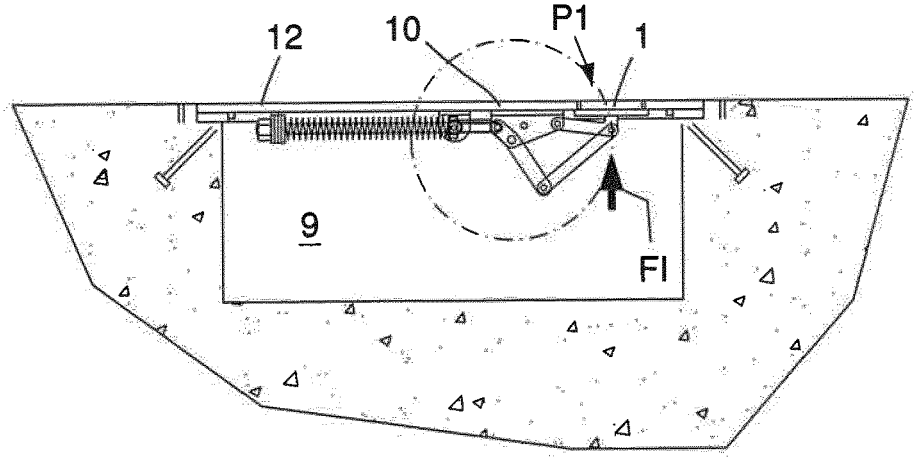
FIG. 2A shows a schematic side view of an embodiment of the floor pit covering system according to the present invention, wherein the floor pit cover system is in a closed position.
Figure 2B:
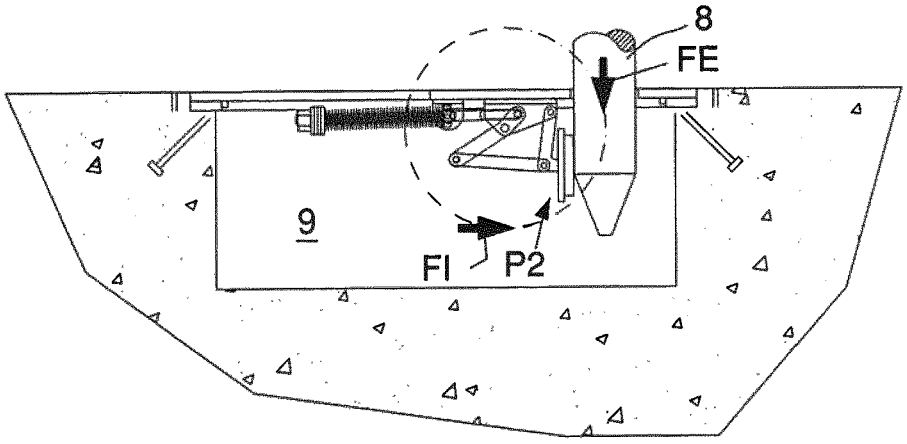
FIG. 2B shows a schematic side view of the embodiment of FIG. 2A, wherein the floor pit cover system is in a open position, interacting with a mullion pin.

The pivoting system 2, which comprises an articulated link system 3 and at least one spring 4, is adapted for arranging the cover plate 1 in a first end position P1 as shown in FIG. 2A or in a second end position P2 as shown in FIG. 2B. By "arranging" is meant either holding the cover plate in one of the two end positions P1, P2, or moving the cover plate, in either direction, between the two end positions P1, P2, i.e., from P1 to P2 or from P2 to P1. Movement is achieved in response to an internal force FI, only, or in response to an internal force FI and an external force FE which interact. The cover plate 1 is held in the first end position P1 when the external force FE is smaller than, or equal to, the internal force FI. The cover plate 1 is moved towards, and subsequently held in, the second end position P2 when the external force FE is larger than the internal force FI.

The first end position P1 for the cover plate 1 is a horizontal position and the second end position P2 is a vertical position. I.e., the floor pit 9 is closed by the pit cover plate 1 that extends flush with the floor in the opening 11 of the pit base plate 10 when arranged in the first end position P1, and the floor pit is open when the cover plate 1, is extending downward into the floor pit 9 and essentially perpendicular to the plane of the floor, is arranged in the second end position P2.

Figure 3:
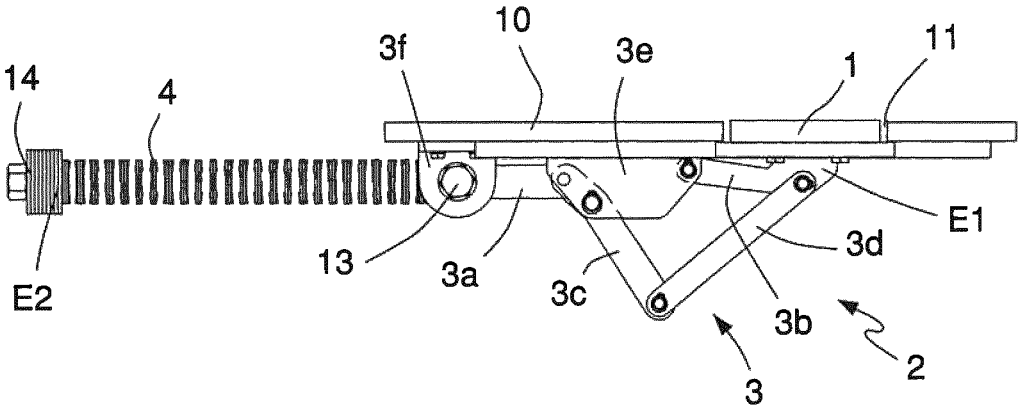
FIG. 3 shows a schematic side view of the embodiment of FIG. 2A, showing only the cover plate and the pivoting system.
Figure 4:
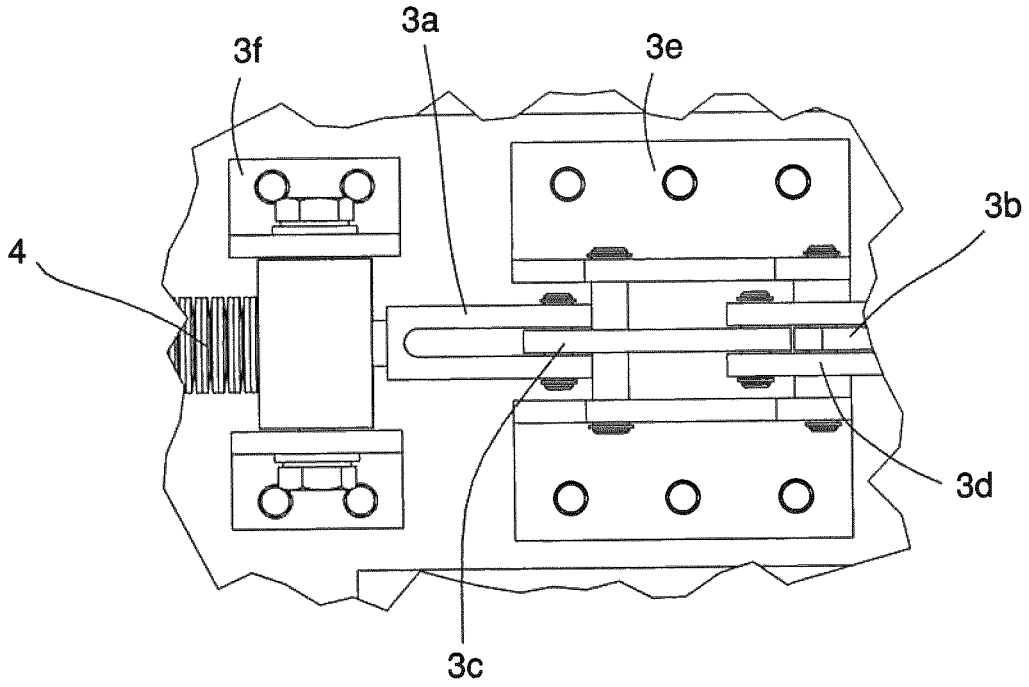
FIG. 4 shows a schematic and partial top view of the embodiment of FIG. 2A.

As shown in FIGS. 3, and 4, the pivoting system 2 comprises of an articulated link system 3, i.e. a spring 4 and a plurality of interconnected components, i.e. a rod 3*a* that is axially moveable in a horizontal plane, a swing arm 3*b*, a double armed crank 3*c*, a connection link 3*d* and a first and second fixed bracket 3*e*, 3*f*. The link system 3 is configured to be articulated in a downward extending vertical plane in the pit 9 on horizontal axes. The cover plate 1 is arranged at a first end E1 of the articulated link system 3, and the spring 4 is arranged at a second end E2 of the articulated link system 3.

With particular reference to FIGS. 3 and 4, the pit cover plate 1 is releaseably attached to a first end of the swing arm 3*b* by bolts, while the spring 4 is attached to a second end of the axially movable rod 3*a*, also surrounding a major part of the rod 3*a*. The rod 3*a* is slidably received in a bore in a pivotable pin 13 to which the rod consequently is axially displaceable and at least slightly pivotable. The spring 4 is acting between an abutment 14 at said second end of the rod 3*a* and the said pin 13. The articulated link system 3 is suspended in an upper part of the floor pit 9, bolted to the underside of the pit base plate 10 via the first and second bracket 3*e* and 3*f* as shown in FIG. 4.

As mentioned here above the cover plate 1 is attached to the free first end of the swing arm 3*b*. A second end of the swing arm 3*b* is pivotally attached to the first bracket 3*e*. Further, a first end of the rod 3*a* is pivotally attached to a first end of the crank 3*c*. A second end of the crank 3*c* is pivotally attached to a first end of the connection link 3*d*. The crank 3*c* functions as a lever between the spring 4 and the swing arm 3*b* for the pit cover 1 having an intermediate section pivotally attached to the first bracket 3*e*. A second end of the connection link 3*d* is pivotally attached to the first end of the swing arm 3*b* under the cover plate 1.

As mentioned, this pivoting system 2 is used for holding and moving the cover plate 1 between the two end positions P1, P2. During cover plate movement, the members in the link system 3 move, while the first and second brackets 3*e*, 3*f* are fixed. The axially movable rod 3*a* is allowed to pivot slightly at its second end during the movement of the cover plate 1. The crank 3*c* pivots around its intermediate section. The connection link 3*d* extending between the crank 3*c* and the swing arm 3*b*, pivots about both ends. The axially movable rod 3*a* pivot slightly about the pin 13 and moves in a horizontal direction, in a direction towards the cover plate 1 when the cover plate 1 is moved from the first end position P1 to the second end position P2. Correspondingly the axially movable rod 3*a* moves in a direction from the cover plate 1 when the cover plate 1 is moved from the second end position P2 to the first end position P1.

As a result of the above, the internal force FI is generated by spring 4. The spring 4 is compressed when the cover plate 1 is moved from the first end position P1 to the second end position P2 by the external force FE, and held in the second end position P2 by the very same force FE. The spring 4 is released when the cover plate 1 is moved from the second end position P2 to the first end position P1, and held in the first end position P1. The force generated by the released spring, the internal force FI, is sufficient to hold the cover plate 1 in the first end position P1. In order to hold the cover plate 1 in the second end position P2, the external force FE, generated by the pressure applied by pin 8, has to be larger than the internal force FI generated by the compressed spring 4.

As previously mentioned, the floor pit covering system is used for covering a floor pit 9. The components of the floor pit covering system are adapted to the dimensions of the actual floor pit 9. E.g., the cover plate 1 may have dimensions corresponding to the size of the mullion pin 8.

As mentioned here above the present floor pit covering system may also be provided with a service plate or a hatch 12, which can be removed such that access to the interior of the floor pit 9 and the spring 4 is allowed. This way, the spring force may be set, when mounted, by accessing the floor pit. Further, the floor pit covering system is hereby easily accessed for service.

The spring 4 surrounding the axially movable rod 3*a* is preferably a disc spring, and the spring force is set be means of a number of exchangeable washers or shims. The spring force is easily adjusted by changing the number of washers, shims or use of similar means. The washers are fitted to the end of the rod 3*d* by means of the abutment 14 at the second end of the axially movable rod 3*a*. The abutment 14 is comprised of a hex nut located at the end of the axially movable rod 4*a*.

With reference to FIGS. 1 and 2A, FIG. 2B, the above described floor pit covering system is operated by means of the following steps.

An internal force FI is applied onto the cover plate 1 such that the cover plate 1 is held in a first, horizontal end position P1, closing the floor pit. The internal force FI is permanently generated by spring 4, the spring 4 being released in the extended position when the cover plate is held in the first end position P1. The internal force FI, generated by the extended spring, is large enough to not only overcome the downwards directed force generated by the weight of the cover plate 1 and pivoting linkage system 3, but also any downwards directed force generated by a vehicle or an individual applying weight onto the cover plate 1.

When splitting the door opening into several smaller door openings by means of mullions 6, an external force FE is applied onto the upper side of the cover plate 1 by the pin 8. This external force FE is set large enough to overcome the predetermined limit value set for the internal force FI of the pivoting system 2. When the external force FE is larger than the opposing internal force FI, the cover plate 1 is moved from the first horizontal end position P1 to the second vertical end position P2, opening the floor pit, holding the cover plate 1 in that position for as long as the external force FE is larger than internal force FI, hence allowing the pin 8 to enter the floor pit 9. This movement is facilitated by the pivoting linkage system 3, which generate movement of rod 3*d* in a direction towards the cover plate 1, compressing the spring 4, and retracting the pivoting system 2 to its smallest horizontal length, i.e. the smallest possible distance between end positions E1 and E2.

When the mullion 6, and the pin 8, is removed, the external force FE is removed from the cover plate 1. As a result thereof, the external force FE becomes smaller or equal to the internal force FI, allowing the previously compressed spring 4 to release and extend. Releasing the spring 4 generates movement of rod 3*d* in the direction from the cover plate, which in turn pivots the linkage system 3, allowing the pivoting system 2 to extend to its largest horizontal length, i.e. the largest possible distance between end positions E1 and E2, and returning the cover plate 1 to the first end position P1.

The invention claimed is:

1. A floor pit covering system arranged to interconnect with a pivotable mullion of a vertical lifting door when the pivotable mullion is positioned vertically, the floor pit covering system comprising:

an axially moving locking mechanism on an end of the mullion, wherein the locking mechanism is movable upward and downward when the mullion is positioned vertically and wherein the locking mechanism generates an external force when the locking mechanism is moved downward;

a cover plate and a pivoting system, said pivoting system being adapted for arranging said cover plate in a first end position or in a second end position in response to an internal force, or the external force being applied onto said cover plate by the axially moving locking mechanism of the pivotable mullion;

said pivoting system configured to position said cover plate in said first end position when the external force is less than or equal to the internal force and in said second end position when the external force exceeds the internal force, wherein said first end position is a horizontal position and said second end position is a vertical position, and wherein said pivoting system comprises an articulated joint system and at least one spring.

2. A floor pit covering system according to claim 1, wherein said internal force is generated by said spring.

3. A floor pit covering system according to claim 1, wherein said cover plate is arranged at a first end of said articulated joint system, and said spring is arranged at a second end of said articulated joint system.

4. A floor pit covering system according to claim 1, wherein said articulated joint system comprises a plurality of interconnected components.

5. A floor pit covering system according to claim 1, wherein said spring is compressed when said cover plate is arranged in said second end position.

6. A floor pit covering system according to claim 1, wherein said floor pit is closed when said cover plate is arranged in said first end position, and said floor pit is open when said cover plate is arranged in said second end position.

7. A method of operating a floor pit covering system, the method comprising providing the floor pit covering system according to claim 1, and comprising:

a) applying the internal force onto said cover plate such that said cover plate is held in a first end position, b) actuating the axially moving locking mechanism to move downward to apply the external force onto said cover plate, c) moving said cover plate to a second end position when the external force exceeds the internal force, d) holding said cover plate in said second end position as long as the external force exceeds the internal force, e) actuating the axially moving locking mechanism to move upward to remove said external force from said cover plate, and f) returning said cover plate to said first end position when the external force is less or equal to the internal force.

8. A method of operating a floor pit cover system according to claim 7, wherein said floor pit is closed when said cover plate is arranged in said first end position, and said floor pit is open when said cover plate is arranged in said second end position.

9. A floor pit covering system according to claim 1, wherein the axially moving locking system comprises a motor operably connected with a pin.

10. A floor pit covering system according to claim 9, wherein the pin is at least partially disposed in the interior of the mullion.

* * * * *